United States Patent [19]

Aghnides, deceased

[11] Patent Number: 4,733,819

[45] Date of Patent: Mar. 29, 1988

[54] SHOWERHEAD WITH MEANS FOR SELECTING VARIOUS FORMS OF OUTPUT STREAMS

[76] Inventor: Elie P. Aghnides, deceased, late of New York, N.Y.; by Chemical Bank, Administrator, New York, N.Y.

[21] Appl. No.: 522,294

[22] Filed: Aug. 11, 1983

Related U.S. Application Data

[63] Continuation-in-part of Ser. No. 269,158, Jun. 1, 1981.

[51] Int. Cl.[4] ..... E03C 1/084; B05B 1/18

[52] U.S. Cl. ..... 239/428.5

[58] Field of Search ..... 239/428.5, DIG. 18, 239/443, 394, 444

[56] References Cited

U.S. PATENT DOCUMENTS

| | | | |
|---|---|---|---|
| 2,670,942 | 3/1954 | Aghnides | 239/391 |
| 2,774,584 | 12/1956 | Aghnides | 261/76 |
| 3,712,548 | 1/1973 | Aghnides | 239/428.5 |
| 3,811,619 | 5/1974 | Aghnides | 239/428.5 |
| 3,829,026 | 8/1974 | Aghnides | 239/428.5 |

FOREIGN PATENT DOCUMENTS

| | | |
|---|---|---|
| 941412 | 2/1974 | Canada . |
| 1182155 | 7/1959 | Fed. Rep. of Germany . |
| 2332437 | 6/1973 | Fed. Rep. of Germany . |
| 2190987 | 6/1973 | France . |
| 0625084 | 6/1949 | United Kingdom . |

*Primary Examiner*—Andres Kashnikow
*Attorney, Agent, or Firm*—Hall, Myers & Rose

[57] ABSTRACT

The present invention is for a showerhead selectively operable to produce a plurality of different streams or different number of streams, enabling the user to select (a) a set of streams having a large diameter, rich in bubbles, when the water pressure is high, (b) a set of streams having a smaller diameter full of bubbles when the water pressure is low, or (c) a spray instead of the bubbly stream. This capability is achieved by having an upstream disc with openings therein for directing the water downstreamwardly in a number of jets. In the path of the jets downstream from said disc there is a rotatable member which can be selectively positioned by the user and which has a number of outlet chambers therethrough, and two or more screen members attached thereto. By adjusting the rotatable member amongst its predetermined positions, the user may select one of several different types of output streams from the showerhead. The showerheads according to this invention may include two co-axial tubular members which interact to permit or prohibit water flow to some of the openings when the showerhead is employed at low water pressures. The present showerhead can be used over an extended range of water pressures to provide large or small bubbly outflows depending on pressure. With the invention, the largest number of bubbly outflows is made possible.

15 Claims, 9 Drawing Figures

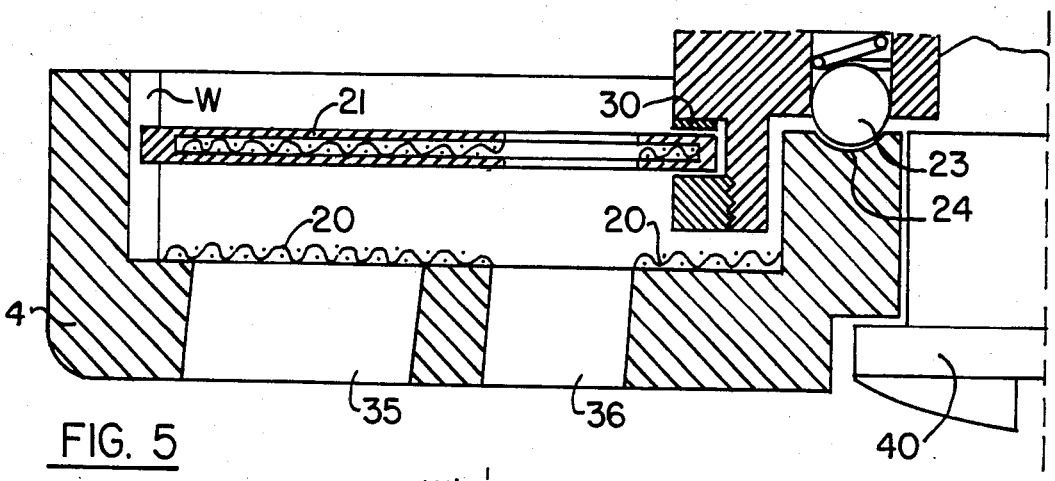
FIG. 5
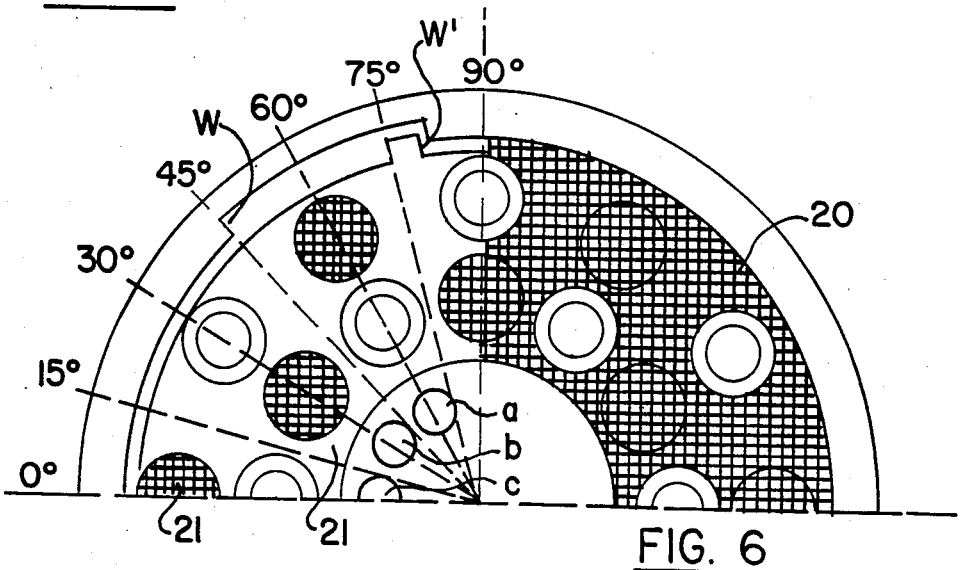
FIG. 6
FIG. 7
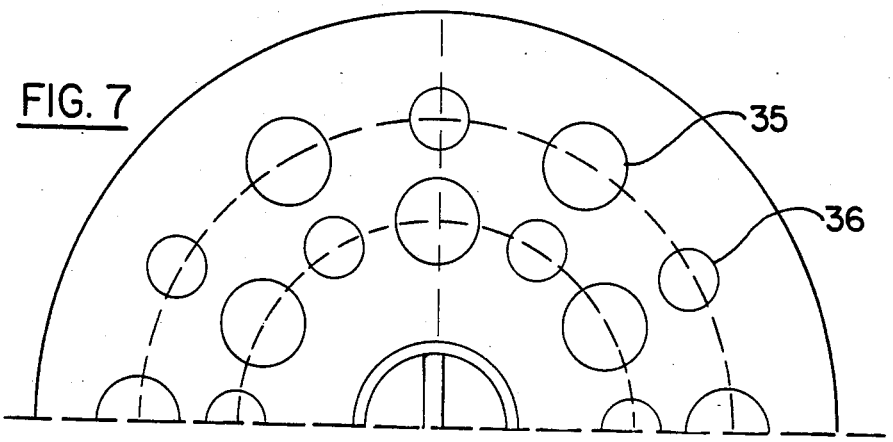

SHOWERHEAD WITH MEANS FOR SELECTING VARIOUS FORMS OF OUTPUT STREAMS

RELATED APPLICATIONS

This application is a continuation-in-part application of my co-pending U.S. patent application Ser. No. 269,158, filed June 1, 1981.

FIELD OF THE INVENTION

This invention relates to water aerators and showerheads. More particularly, this invention relates to showerheads which are adjustable to permit wide variation in the degree of aeration of the water passing through the showerhead, and a wide variation of the characteristics of the water flow out of the showerheads.

BACKGROUND OF THE INVENTION

In my prior patents, for example, U.S. Pat. No. 2,670,942, entitled "Aerator" and issued Mar. 2, 1954, I described a faucet attachment for producing either a coherent jet of aerated water or a spray. In the following three of my U.S. patents, the operator may select either a bubbly stream or a bubble-free jet: U.S. Pat. No. 3,633,824 entitled "Spray-Producing Device In Which The Outputs Are Aerated", issued Jan. 11, 1972; U.S. Pat. No. 3,811,619 entitled "Spray-Producing Device", issued May 21, 1974; and U.S. Pat. No. 3,829,026 entitled "Spray-Producing Device", issued Aug. 13, 1974. However, each of these devices is effective over a limited range of water pressures. In particular, the devices are only effective in high or normal water pressure situations or in low water pressure situations but one device is effective in both types of situations.

The object of the present invention is to provide an improved showerhead effective in a wide range of water pressures, in which the operator may select the type of stream from a variety of streams which is best for his/her purpose.

The present invention is a showerhead selectively operable to produce a variety of output streams, enabling the user to select one set of streams having a relatively large diameter, rich in bubbles, when the water pressure is high, or a second set of streams of a smaller diameter, full of bubbles, when the water pressure is low. Furthermore, the user may select a showerhead output of a spray instead of the bubbly stream, or reduce the number of bubbly or bubble-free jets, thereby forming other sets of stream outputs.

SUMMARY OF THE INVENTION

This invention achieves its objectives by having an upstream disc with chambers therein for directing the water downstreamwardly in a number of jets. These chambers are of the general type shown in FIG. 2 or 3 of my prior U.S. Pat. No. 2,998,929 entitled "Water Aerators", issued Sept. 5, 1961. In the path of the jets from said chambers there is a rotatable member, which is selectively rotatable by the user between a number of predetermined positions and which has a number of openings therethrough and screen members attached thereto. By bringing the desired openings and screen members below the jets, the user may select and produce different sets of streams. One set of the openings can be selected with two of the screen members in line with the openings to produce, at normal or high water pressures, a rich outgoing stream of coherent bubbly water. To produce a coherent bubbly stream at low pressures, the showerhead can be adjusted such that the water passes through a set of openings of a narrowing diameter located downstream just one screen. Similarly, the showerhead can be adjusted such that the water flowing therethrough passes through a set of openings but does not pass through any of the screen members, producing a spray of non-aerated water. Furthermore, the chambers may be duplicated within the upstream disc so that when the user selects a given type of stream, the set of openings that produces that stream type will be receiving all of the water from all of the different chambers. Moreover, some embodiments of my invention provide means for closing the water inlets to some of the chambers, thereby reducing the number of bubbly or bubble-free jets produced by the showerhead, to further permit proper aeration at low water pressures.

IN THE DRAWINGS

FIG. 5 is a partial cross-sectional view of a second embodiment of this invention.

FIG. 6 is a partial top view of the lower screened disc of the embodiment of this invention illustrated in FIG. 5.

FIG. 7 is a partial top view of one possible location of the holes in the lower screen disc illustrated in FIG. 5.

DETAILED DESCRIPTION OF THE DRAWINGS

In my present invention, an adjustable showerhead is provided such that a bubbly stream can be formed by one screen upstream a smaller orifice (in low-water pressure situations) or by two screens (in normal or high water pressure situations), depending on the setting of the showerheads; or the shower-head can be adjusted such that the water only traverses a screenless opening, producing a spray. The showerheads are built such that they form preferably a plurality of jets, so that streams of different diameters and bubble-free jets in greater number than in my prior inventions may be produced.

Figures 1, 2:
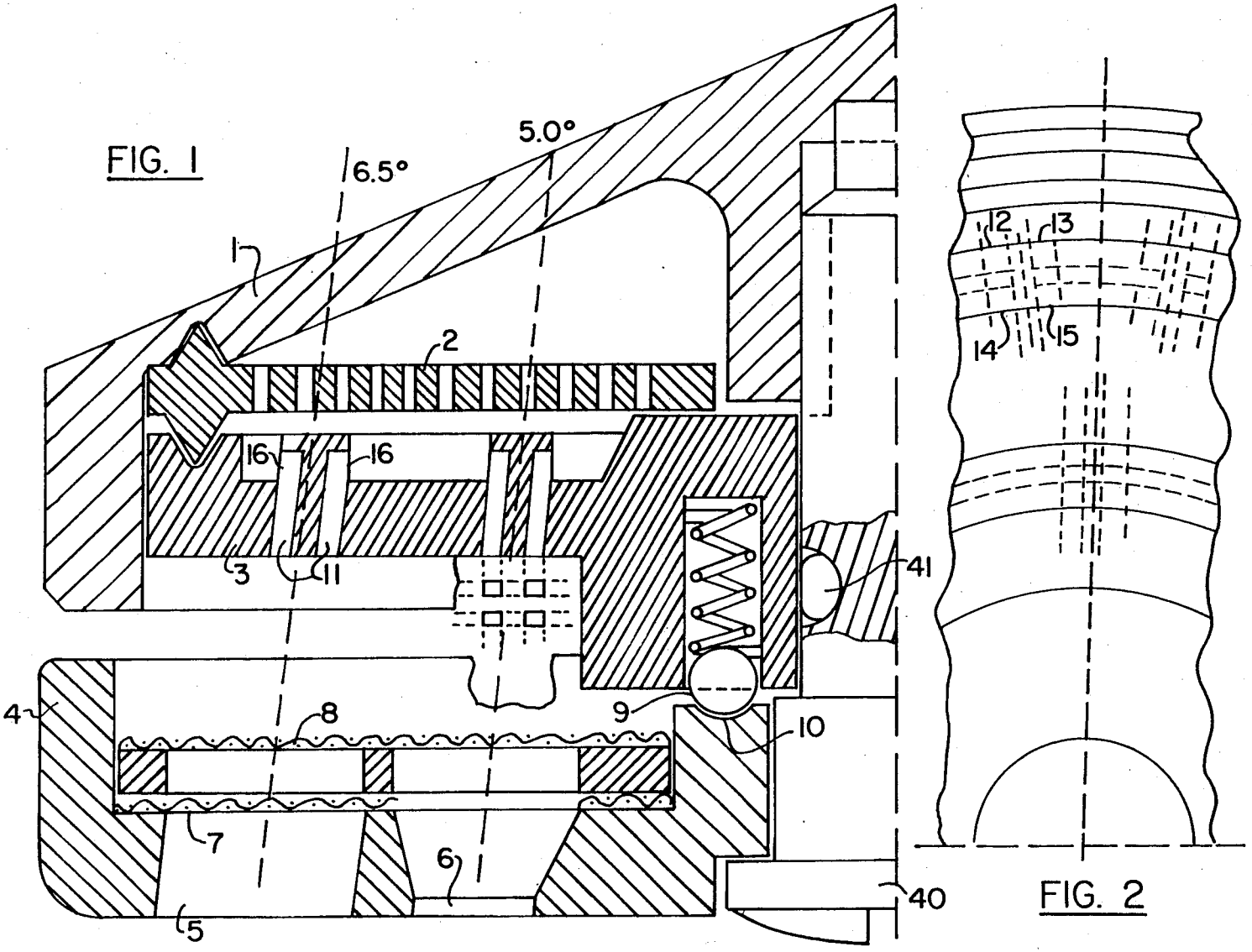
FIG. 1 is a partial cross-sectional view of one embodiment of this invention.
FIG. 2 is a top-view of an arcuate portion of the upstream disc of the embodiment of this invention illustrated in FIG. 1.
Figures 3, 4:
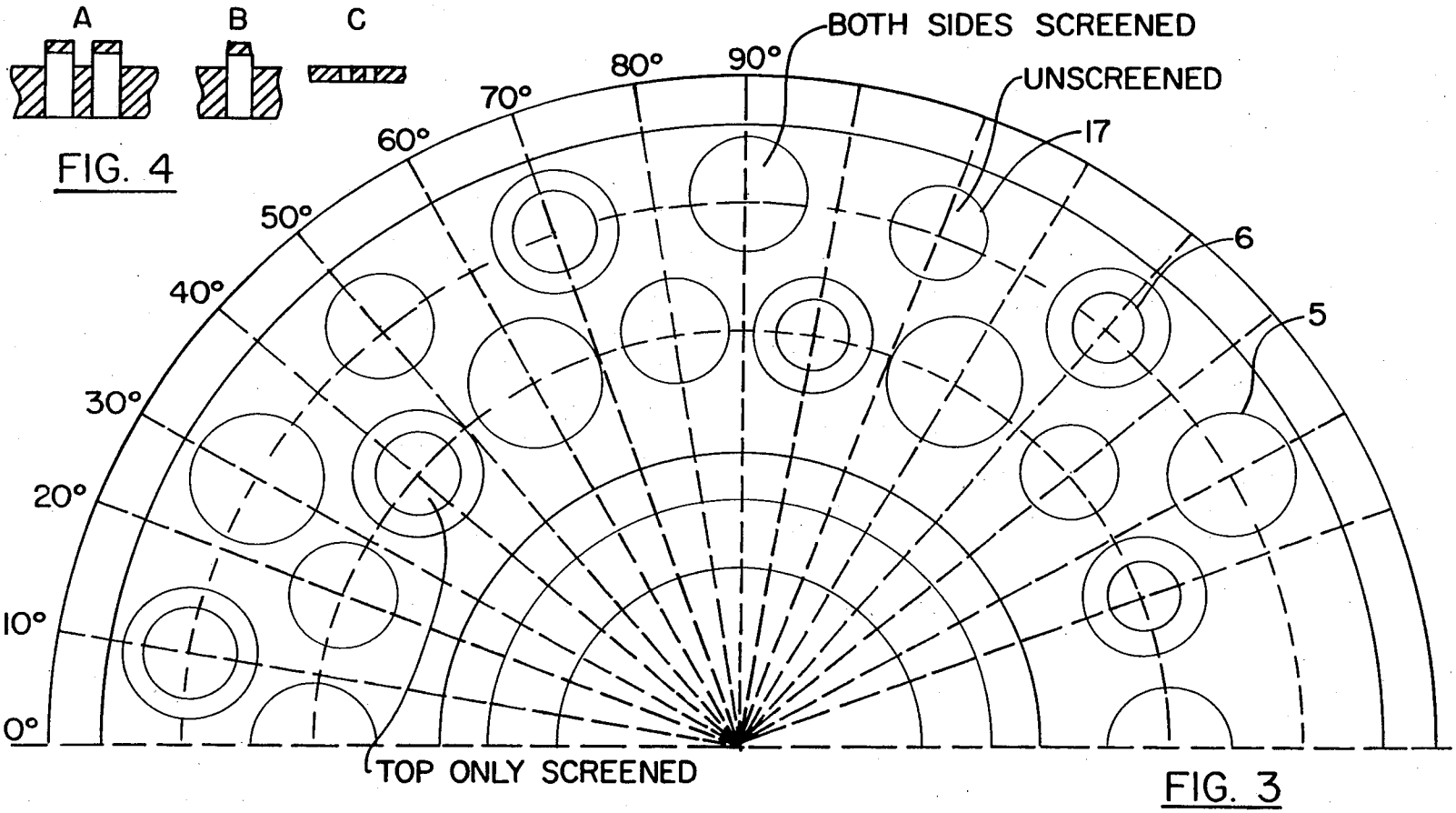
FIG. 3 is a partial top view of a set of typical holes in the downstream screened disc or casing of the embodiment of this invention illustrated in FIGS. 1 and 2, wherein the screens are not shown.
FIG. 4 is a cross-sectional side view of typical chambers that may be used in the disc illustrated in FIG. 2.

Referring to the Figures, and in particular FIG. 1, the embodiment of this invention illustrated includes a rubber-like perforated sieve 2 (the periphery of which serves as a washer), handshower 1, disc 3 (producing jets of high velocity) and rotatable casing 4. Rotatable casing 4 has sets of openings 5 and 6 therethrough, of which openings 5 are topped by two spaced screens 7 and 8, whereas openings 6 are topped only by one screen 8. There is also a set of totally unscreened openings 17 in casing 4, as shown in FIG. 3. Openings 5 and 17 have a constant diameter of 6.75 mm. throughout their height whereas openings 6 have a 4.5 mm. or 5.0 mm. diameter at the outlet end and a 6.75 mm. diameter at their inlet end.

Openings 5, 6 and 17 are arranged in circular rows such that the center points thereof lie in two concentric circles having the same center point as the center of disc 3 (see FIG. 3). There are six of each openings 5, 6, and 17 in each circle, equally spaced apart in the angular direction. Moreover, in the embodiment illustrated in FIG. 3, the openings in the inner row are offset 10° from the openings in the outer row.

Pin 40 holds the assembled parts in position and rubber ring 41 prevents leakage. Casing 4 and disc 3 are attached by a spring and ball assembly which is constructed such that the ball 9 is engaging cavity 10, see FIG. 1.

Disc 3 has two circular rows of groups of holes therein. The holes, in the embodiment illustrated in FIGS. 1–3, are grouped in quadruplets and there are six quadruplet groups in each row totaling 48 holes. Each group is equally spaced in the angular direction from the adjacent groups in its row. The rows are in two circles around the center of disc 3. In another realization 16 triplets in three circular rows of groups were provided, with 8 triplets in the periphery, 4 in the middle row and 4 in the inner row, totaling also 48 holes.

One of said quadruplets is shown in FIG. 2 by dotted lines as holes 12, 13, 14 and 15. The cross-section of each of the holes 11 is 1.0×1.0 mm. and the windows feeding holes 11 with water are 1.0 mm wide and 1.0 mm. high. Holes 11 in the outer circle of holes are offset 30° from the holes 11 comprising the inner circle of holes.

The circles connecting the centers of openings 5, 6 and 17 directly underlie circles connecting the midpoints of the sets of quadruplet holes 11. The rotatable casing 4 of this embodiment can be stopped either (1) in the position in which the jets from the 12 quadruplets of holes 11 traverse the 12 openings 5 and screens 7 and 8, producing 12 bubbly streams of 6.75 mm. diameter each, (2) in the position in which said 12 quadruplets of holes 11 traverse the openings 6 and screens 8 producing 12 bubbly streams of 4.5 mm. (or 5.0 mm. diameter each) or (3) in a position in which said quadruplets of jets traverse the said 12 totally unscreened openings 17 shown in FIG. 3, of 5 mm. diameter each producing 48 bubbly-free jets. As can be seen from FIG. 3, each of these positions is 20° apart from the adjacent position.

It will be noted that, in FIG. 1, the openings 6 are of 6.75 mm. diameter at their upstream ends and gradually narrow down to a diameter of 4.5 mm. or 5.0 mm at their downstream ends, so that the sharp jets from orifices 11, broken up by screen 8 gradually coalesce in openings 6 and discharge as a coherent bubbly stream of 4.5 mm. or 5.0 mm. diameter.

When the showerhead is in the second position discussed above, that being when the water is traversing the openings 6, and screen 8, the bubbly streams produced by the high velocity quadruplets of jets from holes 11 which traverse the one and only screen complementary to openings 6, have proven to have more vigor, velocity and bubbles than the bubbly stream produced heretofore by one jet, delivered by holes of the type shown in FIG. 4 by A or B or C (any of which holes may be used in the present invention), traversing a set of two screens.

It is recommended that the showerhead be placed in the first position discussed above when the showerhead is employed in a normal or high water pressure situation and when the user desires an output of a fully bubbly stream of water. On the other hand, when the showerhead is employed in a low water pressure situation, but the user still desires an output of a fully bubbly stream of water, it is recommended that the showerhead be set in the second position discussed above. Lastly, if the user wants an output of a spray of water having no bubbles entrained therein by the showerhead, the user should set the showerhead in the third position discussed above, irregardless of the pressure of the system.

Some of the showerheads of my said prior patents made and sold in Europe and U.S.A. include discs having one of the types of holes shown in FIG. 4. In these showerheads two screens in the path of single jets were used to produce an output of a fully bubbly stream of water. These prior showerheads had 16 holes of 1.25×1.25 mm. cross-section topped each by two entrance openings of 1.0×0.95 mm. each.

Some of my European showerheads were constructed such that they could be adjusted to produce alternately either a set of 16 bubbly streams of 4.5 mm. or 5.5 mm. diameter each (position 2 above) or a set of 16 bubbly-free jets (position three above). However, these prior showerheads are not very effective when it is desired to not deliver more than three gallons of water per minute under a back pressure of 80 p.s.i., as is now required under some laws and regulations in the United States. Thus, while the intent of said laws is to save water, the ineffectiveness of my prior said showerheads for operation when the flow rate is designed not to exceed three gallons per minute in the use of the conventional showerheads which waste half of the showering water in splash. The bubbly streams resulting from my showerheads end splash and put to use all the water drawn through the showerhead.

None of my prior showerheads are adjustable to the three positions discussed above such that they are effective over a wide range of water pressures.

A comparison between my prior foam-producing showerheads and showerheads according to the present invention (of the same size) resulted in a finding that the prior showerheads have a rate flow of 16 liters per minute at 1.5 atmospheres whereas the showerheads of my present invention have a rate of flow of 18 liters per minute under the same 1.5 atmospheres. Moreover, at water outlets under relatively low water pressure, the present showerheads produce fully bubbled streams whereas my prior showerheads did not. Thus, the showerheads according to this invention will help save a great deal of water by producing a vast amount of foam over a greater range of water pressures than my prior showerheads.

It is understood that the functional parts of the handshower just described may be embodied in a head shower and the number as well as the rows of the said holes and openings may be decreased or increased if a larger or smaller rate of flow is required. Further, such showerheads may comprise, in addition to the three different types of openings discussed above, a fourth type with larger cross-sections and equipped, if needed, with three screens, for the production of bubbly streams of larger cross-sections, for use, for example, in sports clubs.

FIGS. 5, 6 and 7 illustrate a showerhead according to this invention which produces four different types of output streams. This embodiment includes downstream screen 20 permanently attached to the casing 4 and upstream screen 21 which is rotatable within casing 4, such rotation being effected automatically by the rotation of casing 4 as will be discussed below.

This embodiment includes a ball and spring assembly 23 as did the embodiment discussed above. There are three partial spherical depressions, designated a, b and c, in casing 4 (see FIG. 6), for engaging the ball of ball and spring assembly 23 to hold casing 4 in one of three positions with respect to the rest of the showerhead. The centers of depressions a, b and c are spaced 30° apart as shown in FIG. 6. As casing 4 is being rotated, the ball 23 which at first will be in depression c (a first position), will fall next in depression b (a second position) after the casing is rotated 30°, and then in depression a when the casing is rotated another 30°, for a total rotation of 60°.

The half-tight rubber ring 30 prevents the accidental rotation of the framed screen 21. In the embodiment of this invention illustrated in FIGS. 5, 6 and 7, holes 35 have a diameter of 6.75 mm. and holes 36 a diameter of 5.0 mm.

This embodiment of the invention includes a lost motion apparatus including slot W and extrusion W'. Screen 21 will be carried along by, and rotated when, slot W of casing 4 is abutting extrusion W' of screen 21 and when casing 4 is being rotated.

This lost motion apparatus functions as follows. If the showerhead illustrated by FIGS. 5–7 is in the first position described above, such that the ball of ball and spring assembly 23 is in depression c, when casing 4 is rotated 30° (clockwise as shown in FIG. 6) to the second position, such that the ball engages depression b, only the casing 4 will have rotated, and not screen 21, since during this initial rotation, slot W is moving relative to extrusion W'. Slot W does not contact extrusion W' until casing 4 has been rotated 30° since slot W is approximately an arc of 30°.

When casing 4 is continued to be rotated from 30° to 60° (from the second to the third position), and the ball moved from depression b to depression a, the left side (as shown in FIG. 6) of slot W will abut extrusion W' and rotate extrusion W', as well as the entire screen 21, 30° in the clockwise direction also. When casing 4 is then rotated in the opposite direction, 30°, (until the ball is back in depression b), screen 21 will remain stationary as slot W moves relative to extrusion W'. Then, if casing 4 is rotated another 30°, such that the ball moves from depression b to depression c, the right side (as shown in FIG. 6) of slot W will contact extrusion W' and rotate screen 21 all the way back to its initial resting place.

The resulting effect on the water flow characteristics of the water passing through this embodiment of this invention when casing 4 and screen 21 are in the numerous positions described above, is as follows. When casing 4 is at stop-point 0° (the ball is in depression c), the water will traverse both screens 20 and 21 and holes 35 and 12 bubbly streams of 6.75 mm. diameter each will be produced. When casing 4 has been rotated 30°, such that the ball is in depression b, the 12 quadruplets of 4 jets each will traverse openings 35 of 6.75 mm. diameter but only screen 20, and not screen 21. The output of the showerhead in this setting will be a stream comprised of brokenup non-coherent jets of water. When casing 4 is further rotated 30° such that the ball is in depression c, to make a total rotation of 60°, each quadruplet of jets will traverse a single screen 21 and a hole 36 having a 5.0 mm. diameter outlet. This will produce a bubbly stream having a 5.0 mm. diameter. Next, when casing 4 is rotated in the opposite direction by 30°, the 12 quadruplets of jets will traverse the 12 unscreened openings in screen 21, and the showerhead will produce 48 bubble-free jets. When casing 4 is then returned to its initial position, at 0°, the 12 bubbly streams of 6.75 mm. diameter produced by screens 20 and 21 and openings 35 will again be the resultant stream flow.

Figure 8:
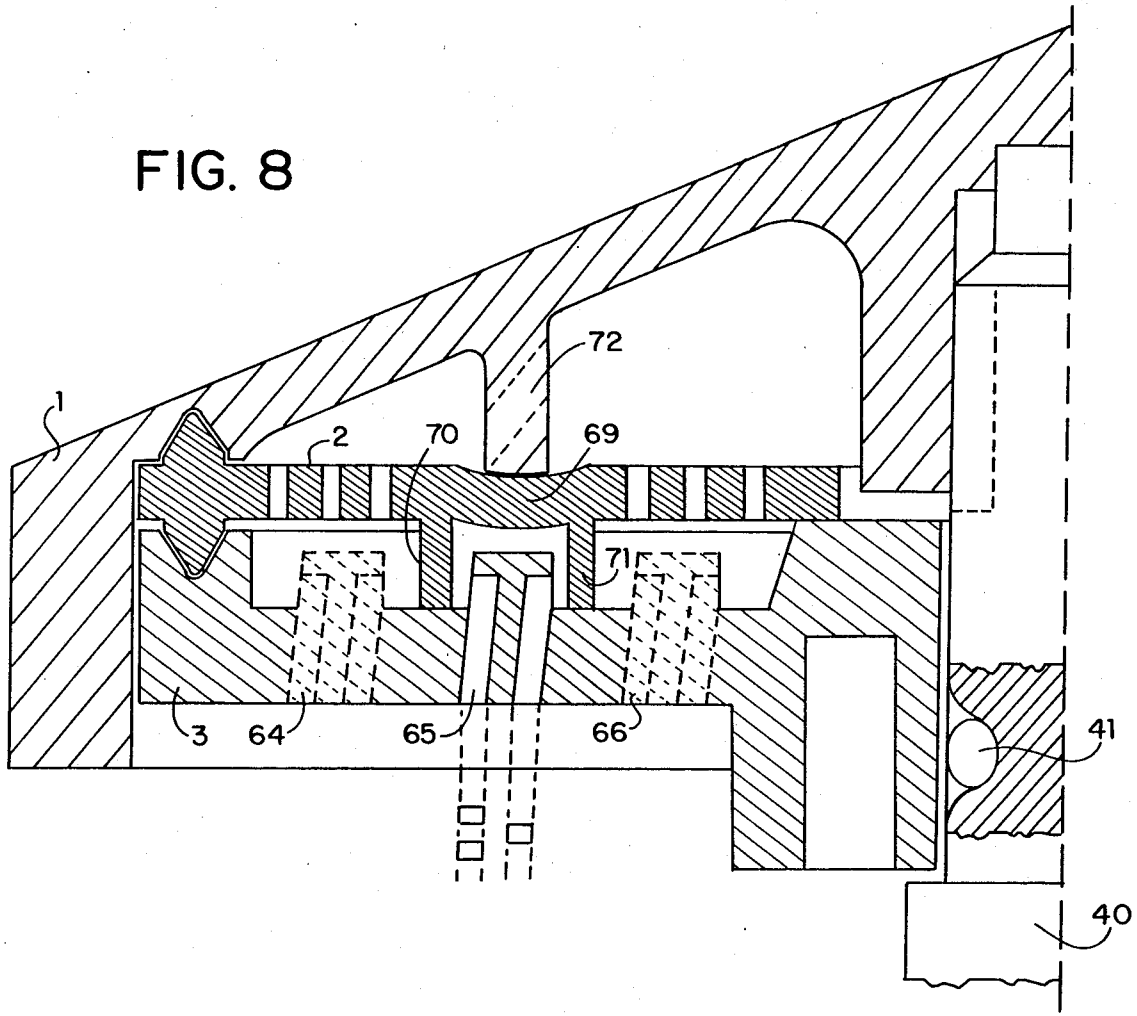
FIG. 8 is a partial cross-sectional side view of a disc of a third embodiment of this invention, which includes means for closing off some of the chambers of the showerhead from the water flow for effectively aerating the water passing through the showerhead at low pressures.

The embodiment of this invention illustrated in FIG. 8 includes means for decreasing the number of orifices 64,65 and 66 in the disc 67 of the showerhead through which water is allowed to pass during operation of the showerhead, as another method to permit effective operation at low water pressures. This is achieved by providing washer 2 with an imperforate portion 69 and annular walls 70 and 71. In the position shown the middle row of holes is closed and when said washer is put upside down all holes 64,65 and 66 will remain open. The position shown is advisable when using the showerhead in low water pressure. Several prongs 72 exert pressure upon portion 69 to insure sealing.

Figure 9:
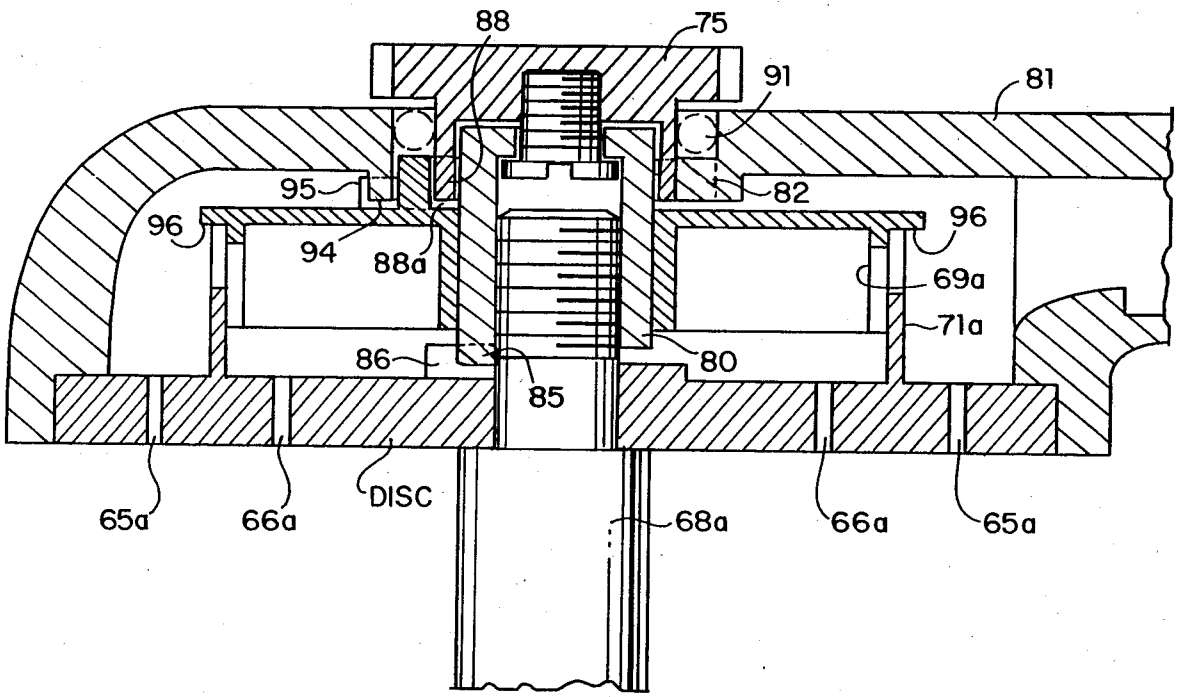
FIG. 9 is a partial cross-sectional side view of a disc of yet another embodiment of this invention, which includes a rotatable external knob operable to close off some of the chambers of the showerhead from the water flow.

The embodiment of this invention illustrated in FIG. 9 permits the user of the showerhead to select the number of orifices 65*a* and 66*a* the water will be allowed to pass through. This is accomplished by manipulating knob 75 located outside the showerhead. Tubular portion 69*a* is rotatable by knob 75 which is connected with tubular portion 69*a* by means of prongs 88 which extend downward from knob 75 and are housed in groove 88*a*. Further, the desired degree of rotation of member 69*a* is achieved by prongs 94 of the showerhead which project into groove 95. Rubber ring 91 prevents leakage from the knob/showerhead interface.

Portion 80 is connected to member 81 of the showerhead by webs 82. The disc has grooves 86 within which receive web 85 for proper positioning of the disc.

Member 69*a* is mounted around member 80 in frictionable but rotatable contact so as to avoid leakage towards the isolated inner row of holes 66*a* when knob 75 is rotated to the position disallowing water to reach holes 66*a*. When the apparatus is in the position illustrated in FIG. 9, the water passing through the showerhead reaches both rows of holes 65*a* and 66*a*. Knob 75 can be rotated such that the water does not have access to holes 66*a*.

The upper edge of tubular wall 71*a* supports lip 96, improving the sealing between contacting walls 69*a* and 71*a*. Thus member 69*a* is supported by tubular wall 71*a*.

Unlike the prior showerheads, the showerheads according to this invention have the capability to be adjusted to be effective over a wide range of water pressures. when the showerheads of this invention are used in normal or high pressure systems, the showerhead can be set such that the jets of water passing through disc 4 traverse two screens and one set of openings. It is well known in this art that if water passing through a showerhead is under normal or high pressure, and if two screens are placed in the path of the water, a fully bubbly output stream will be produced.

When the showerheads of this invention are used in low pressure situations, the showerheads can be adjusted such that the water passing therethrough traverses only one screen, however, after passing through the one screen, the stream of water passes through an orifice which has inwardly sloping walls (conically shaped) to a narrower outlet. This arrangement produces a stream of fully bubbly water, however, the diameter of the stream is smaller than the diameter of the stream passing through two screens. Under low pressures, the lesser resistance to the water flow by the single screen entrains large volumes of air in the water, and then the water is coalesced as it passes through the narrowing chamber below the screen.

This ability to be effective in a wide range of water pressure situations is a feature not present in any of the prior patents or devices. In my U.S. Pat. No. 3,811,619, there is disclosed a showerhead which is adjustable to produce a variety of stream flows. However, these showerheads do not have the capability of producing a fully bubbly stream at low pressures, unlike the showerheads according to the present invention.

If the showerheads of U.S. Pat. No. 3,811,619 are set such that the water passes through two or more screens, and if the water is under low pressure, then the output water will not be a bubbly, coherent stream. Likewise, if these showerheads are set such that the water traverses one screen, a fully bubbly stream will still not be produced since these showerheads do not have orifices with a narrowing diameter between the screens and the outlets of the showerheads. It is of course, well known in the art that if in a showerhead a high velocity jet only passes through one screen, and an opening having the same or larger diameter as the screen, the output is an incoherent stream of droplets of water. Nothing in U.S. Pat. No. 3,811,619 teaches the inclusion of a setting allowing the water in the showerheads to pass through one screen and a narrower or conical opening below the screen.

The showerheads of this invention can also be set to produce jets of non-bubbly water by setting the showerheads such that the water passing therethrough does not traverse any screens. Finally, the showerheads according to this invention can be set such that the water passing therethrough traverses one screen without then passing through a narrowing chamber. This produces non-coherent jets of bubbly water at the output ends of the showerheads.

Moreover, in some embodiments of this invention, for example, the embodiment illustrated in FIGS. 8 and 9, the showerheads can be adjusted to reduce the number of orifices in the discs through which the water passes. This feature further enhances the utility of the showerheads according to this invention at low water pressures.

Other improvements, modifications and embodiments will become apparent to one of ordinary skill in the art upon review of this disclosure. Such improvements, modifications and embodiments are considered to be within the scope of this invention as defined by the following claims:

I claim:

1. In a device for producing bubbly streams over a range of water pressures:

means for receiving water from a source and producing an output comprising jets of water, first means which when in the path of said jets breaks up said jets, offers resistance thereto, and mixes the resulting water with air to produce a bubbly jet of a first cross-section when the air pressure is in the higher part of said range, second means which when in the path of said jets breaks up said jets, offers resistance thereto in a lesser amount than that offered by said first means, and mixes the resulting water with air to produce a bubbly jet of a second cross-section, that is smaller than said first cross-section, when the water pressure is in the lower part of said range, and means operable for selectively causing said jets to either impinge only on said first means or only on said second means.

2. In a device as defined in claim 1, said first means comprising two screens and said second means comprising one screen.

3. In a device for producing bubbly streams over a range of water pressures as defined in claim 1, in which:

said first means having an output orifice of said first cross-section which determines the cross-section of the bubbly jet when the jets impinge on said first-means, and said second means having an output orifice of said second cross-section which determines the cross-section of the bubbly jet when the jets impinge on said second means.

4. In a device for producing bubbly streams over a range of water pressures:

means for receiving water from a source and producing an output comprising jets of water, first means which when in the path of said jets breaks up said jets, offers resistance thereto, and mixes the resulting water with air to produce a bubbly jet of a first cross-section when the water pressure is in the higher part of said range, second means which when in the path of said jets breaks up said jets, offers resistance thereto in a lesser amount than that offered by said first means, and mixes the resulting water with air to produce a bubbly jet of a second cross-section, that is smaller than said first cross-section, when the water pressure is in the lower part of said range, and means operable for selectively causing said jets to either impinge only on said first means or only on said second means, said second means defining a passageway having said one screen across said passageway, said passageway tapering to thus narrow the same until its size substantially equals said second cross-section.

5. In a device for producing bubbly streams over a range of water pressures, jet producing means for connection to a source of water to produce at least one jet of water, control means having at least a high pressure setting and a low pressure setting, said control means, when in said high pressure setting, comprising first mixing means to break up the water of said jets and mix that water with air to form a bubbly stream of a first cross-section when the water pressure from said source is in the higher end of said range, said control means, when in said low pressure setting, comprising second mixing means, having lesser mixing capability than the mixing means involved in said high pressure setting, for providing sufficient mixing of the water from said jet forming means to break up the flow of that water and mix that water with air to form a bubbly stream of a second cross-section, smaller than said first cross-section, when the water pressure from said source is in the lower end of said range.

6. A device according to claim 5, in which:

said control means including a screen movable to form a part of said first mixing means when said control means is in said high pressure setting but not forming a part of said second mixing means when said control means is in said low pressure setting.

7. A device according to claim 5, in which:

said control means having a third setting in which the output of said device comprises said jets discharging from the device in the form of a spray.

8. A device according to claim 7, in which said control means comprises a movable screen and a lost motion connection associated with said movable screen, said lost motion connection positioning said movable screen so it functions as a part of said first mixing means in said high pressure setting, but does not function as a part of said second mixing means in said low pressure setting.

9. In a device for producing bubbly streams over a range of water pressures as defined in claim 5, in which:

said control means having an output orifice of said first cross-section which determines the cross-section of the bubbly jet when the control means is in said high pressure setting, and said control means also having an output orifice of said second cross-section which determines the cross-section of the bubbly jet when the control means is in said low pressure setting.

10. In a device for producing bubbly streams over a range of water pressures, jet producing means for connection to a source of water to produce at least one jet of water, control means having at least a high pressure setting and a low pressure setting, said control means when in said high pressure setting, comprising first mixing means to break up the water of said jets and mix that water with air to form a bubbly stream of a first cross-section when the water pressure from said source is in the higher end of said range, said control means, when in said low pressure setting, comprising second mixing means having lesser mixing capability then the mixing means involved in said high pressure setting, for providing sufficient mixing of the water from said jet forming means to break up the flow of that water and mix that water with air to form a bubbly stream of a second cross-section, smaller that said first cross-section, when the water pressure from said source is in the lower end of said range, each said mixing means comprising screen means, said control means including a passageway, when in said low pressure setting, that includes at least a part of said screen means, said passageway narrowing, downstream of said screen means, to said second cross-section.

11. In a device for producing a bubbly output stream over a range of input pressures:

jet forming means for connection to a source of water under pressure for producing at least one jet, bubbly stream forming means downstream of said jet forming means for breaking up the water in said jet and mixing that water with air and discharging the water as a bubbly output stream, and control means for correcting said bubbly stream forming means for different water pressures comprising means that includes at least one high pressure setting and at least one low pressure setting, said control means providing a greater mixing of the water with air in said high pressure setting than in said low pressure setting and providing a narrower cross-section of said output stream when said control means is in said low pressure setting than when it is in said high pressure setting.

12. In a device as defined in claim 11, there being only one high pressure setting and one low pressure setting, each of said settings consisting of a single position.

13. In a device as defined in claim 11, said control means comprising a screen, and a lost-motion connection for moving said screen in the path of said jet to provide the greater mixing effect in said high pressure setting.

14. In a device for producing a bubbly output stream over a range of input pressures, as defined in claim 11, in which:

said control means having an output orifice of a first cross-section which determines the cross-section of the bubbly jet when said control means is in said high pressure setting, and said control means also having an output orifice of said narrower cross-section which determines the cross-section of the bubbly jet when said control means is in said low pressure setting.

15. In a device for producing bubbly streams over a range of water pressures:

means for receiving water from a source and producing an output comprising jets of water, first means which when in the path of said jets breaks up said jets, offers resistance thereto, and mixes the resulting water with air to produce a bubbly jet of a first cross-section when the water pressure is in the higher part of said range, second means which when in the path of said jets breaks up said jets, offers resistance thereto in a lesser amount than that offered by said first means, and mixes the resulting water with air to produce a bubbly jet of a second cross-section, that is smaller than said first cross-section, when the water pressure is in the lower part of said range, and means operable for selectively causing said jets to either impinge only on said first means or only on said second means, said second means defining a passageway tapering to thus narrow the same until its size substantially equals said second cross-section.

* * * * *

UNITED STATES PATENT AND TRADEMARK OFFICE

CERTIFICATE OF CORRECTION

PATENT NO. : 4,733,819

DATED : March 29, 1988

INVENTOR(S) : Elie P. AGHNIDES, deceased, late of New York, N.Y. by Chemical Bank, Administrator, New York, N.Y.

It is certified that error appears in the above-identified patent and that said Letters Patent is hereby corrected as shown below:

Claim 1, line 8 (col. 7, line 64), change "air" to --water--.

Claim 4, line 20 (col. 8 line 39), cancel "said". (second occurrence).

Signed and Sealed this

Twenty-sixth Day of July, 1988

*Attest:*

*Attesting Officer*

DONALD J. QUIGG

*Commissioner of Patents and Trademarks*